US005649869A

United States Patent [19]

Infantino et al.

[11] Patent Number: 5,649,869

[45] Date of Patent: Jul. 22, 1997

[54] FLUORESCENT BOWLING PINS

[75] Inventors: Joseph R. Infantino, Chappaqua; Ronald J. Pominville, Glenfield, both of N.Y.

[73] Assignee: AMF Bowling, Inc., Mechanicsville, Va.

[21] Appl. No.: 688,812

[22] Filed: Jul. 31, 1996

[51] Int. Cl.[6] ..... A63D 9/00

[52] U.S. Cl. ..... 473/118; 273/DIG. 24; 473/119

[58] Field of Search ..... 473/54, 69, 70, 473/71, 101, 118, 119; 273/DIG. 24

[56] References Cited

U.S. PATENT DOCUMENTS

| | | | |
|---|---|---|---|
| 280,807 | 7/1883 | Farley . | |
| 716,645 | 12/1902 | Ransom . | |
| 2,387,512 | 2/1945 | Hilberg | 250/71 |
| 2,949,303 | 8/1960 | Sherman | 273/51 |
| 2,990,177 | 6/1961 | Hutchison | 273/51 |
| 3,301,558 | 1/1967 | Clapham | 273/51 |
| 3,630,601 | 12/1971 | Lebovec | 356/256 |
| 3,709,495 | 1/1973 | Krombein | 273/101 |
| 3,717,343 | 2/1973 | Hartford | 273/30 |
| 3,917,264 | 11/1975 | Davidson et al. | 273/3 |
| 3,918,719 | 11/1975 | Welch | 273/176 |
| 3,971,560 | 7/1976 | Panosh | 273/30 |
| 4,322,078 | 3/1982 | Mallette | 273/82 |
| 4,445,688 | 5/1984 | Frillici et al. | 273/82 |
| 4,481,422 | 11/1984 | deMarco et al. | 250/459.1 |
| 4,798,386 | 1/1989 | Berard | 273/235 |
| 5,174,571 | 12/1992 | Aubusson et al. | 273/31 |
| 5,417,438 | 5/1995 | Poff | 273/411 |
| 5,449,326 | 9/1995 | File | 473/55 |
| 5,489,241 | 2/1996 | Perrier | 473/115 |

OTHER PUBLICATIONS

James Cook; Coloring Plastics For Special Effects;Day–Glo Color Corp.; (Plastics Compounding, Jul./Aug. 1984) pp. 53–56.

*Primary Examiner*—William M. Pierce
*Attorney, Agent, or Firm*—David E. Dougherty

[57] ABSTRACT

A bowling pin for use with an automatic scorer includes a wood core and an ionomer cladding having an outer surface which surrounds the standing portion of the pin. The pin includes a first fluorescent coating on the outer surface in a preselected area, preferably in the neck portion of the pin. This first fluorescent coating emits a relatively high level of visible light when subjected to ultraviolet light. A second fluorescent coating, which is colorless under ambient light, covers the standing portion of the pin, including the first fluorescent coating and emits a relatively low level of visible light, i.e., the moonglow effect. The second coating also allows the relatively high-intensity visible light which is emitted from the first fluorescent coating to pass therethrough for detection by an automatic scorer.

7 Claims, 1 Drawing Sheet

FLUORESCENT BOWLING PINS

FIELD OF THE INVENTION

This invention relates to a fluorescent bowling pin for use with an automatic scorer under visible and/or ultraviolet (UV) illumination, but more particularly to a fluorescent bowling pin which has improved scoring characteristics, i.e., an improved ability to be detected by automatic scoring devices.

BACKGROUND OF THE INVENTION

In recent years bowling alley proprietors have tried a number of variations on conventional bowling in an attempt to increase business. For example, many alleys have added retractable bumpers to one or more alleys in an effort to attract the younger and less experienced bowlers during off hours, i.e., times which are not reserved for league bowling. Another approach which is gaining in popularity is the so-called "moonlight" bowling. In moonlight bowling, the lights of the bowling center are dimmed and lighting above the lanes are turned off. The pins and certain areas of the alley are coated with a fluorescent dye and then illuminated with ultraviolet light to produce a soft glow, to simulate a moonlit environment.

While moonlight bowling has grown in popularity, there have been problems with the use of automatic scorers under moonlight conditions. In some cases, the fluorescent light is insufficient for detection by an automatic scorer, even in those cases where the pins are relatively new. A more serious problem relates to the relatively poor light stability or relatively rapid degradation of the fluorescent illumination due to repeated exposure to visible and/or ultraviolet light. Since the pins are also customarily used for ordinary bowling under normal lighting conditions, their usefulness for moonlight bowling is short-lived.

An additional problem is caused by the poor abrasion resistance of the fluorescent dye coatings. As the bowling pins are repeatedly struck by other pins, the fluorescent dye coating is worn away. When the fluorescent coating is worn off, an automatic scorer will not detect a standing pin which results in an error in the scoring process.

It has now been found that an improved bowling pin in accordance with the present invention overcomes the aforementioned problems to a relatively large degree. For example, the improved bowling pins have longer life for moonlight bowling due to greater light stability. Such pins also produce a very different visual effect, a greater resistance to abrasion in a selected area which is used for automatic scoring and produce a higher level of visual illumination which results in more accurate scoring.

The improved fluorescent pins disclosed herein are relatively durable, have an enhanced appearance and brightness for ordinary bowling as well as moonlight bowling, are more abrasion resistant in selected areas and can be manufactured and sold at a competitive price. It is also believed that such pins may be readily refurbished by the bowling center of manufacturer.

BRIEF SUMMARY OF THE INVENTION

In essence, the present invention contemplates a fluorescent bowling pin for use with an automatic scorer under visible and/or ultraviolet illumination. The fluorescent bowling pin includes a core member such as a solid wood core and an ionomer cladding having an outer surface surrounding the core member. The pin also includes a base insert, for example, a conventional nylon base. As contemplated by the invention, the fluorescent pin includes a first fluorescent coating which emits a relatively high level of visible light when subjected to ultraviolet radiation over a selected area of the ionomer cladding. The selected area is preferably a band or stripe around an upper portion or neck of the pin. It is this selected area of a standing pin which is detected by a pin sensor of an automatic scorer. The fluorescent bowling pin according to a preferred embodiment of the invention also includes a second fluorescent coating over a majority of the outer surface of the ionomer cladding. The second coating emits a relatively low level of visible light when subjected to ultraviolet radiation, i.e., the so-called moonglow effect.

The invention will now be described in connection with the accompanying drawings wherein like reference numerals have been used to designate like parts.

DESCRIPTION OF THE PREFERRED EMBODIMENTS OF THE INVENTION

Figure 1:
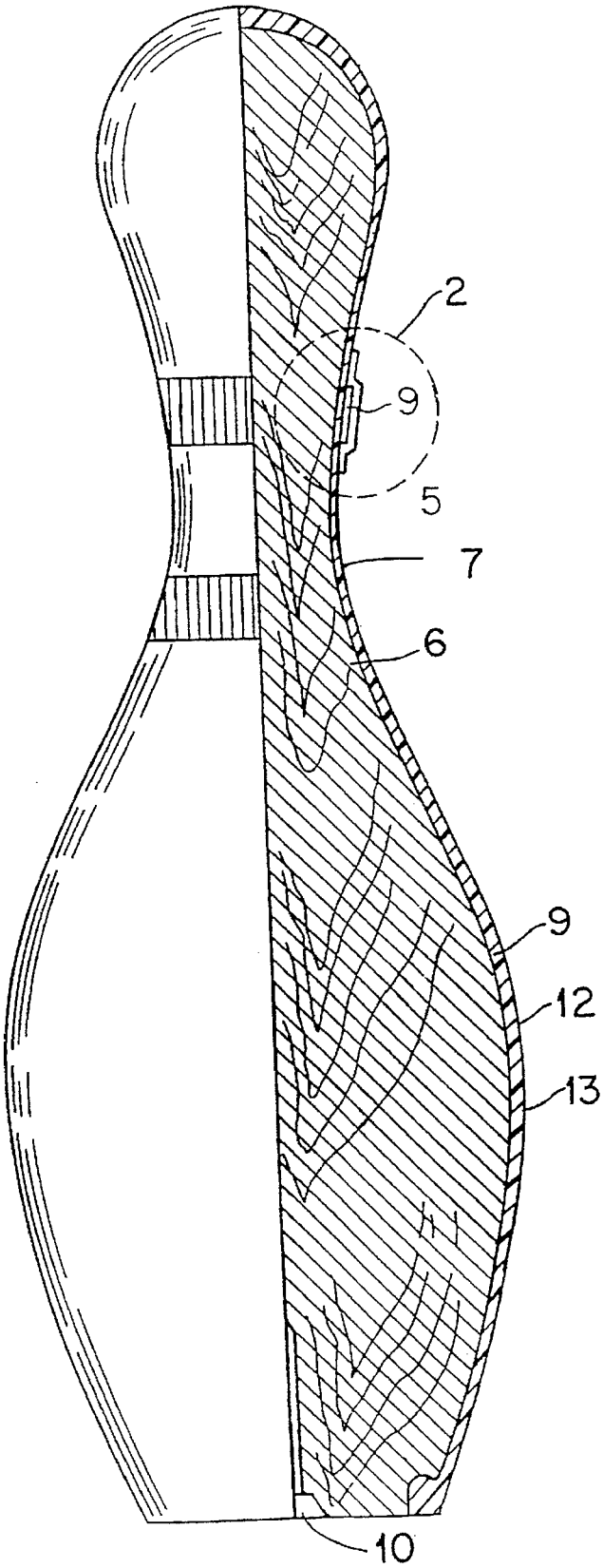
FIG. 1 is a vertical, elevational view partly in section of a bowling pin in accordance with the present invention.

In a first embodiment of the invention, a bowling pin 5 comprises a wood core 6 of maple or other hard wood encased with plastic cladding or cover 7. The plastic cladding 7 is preferably made of an ionomer resin, the composition of which is disclosed in an earlier U.S. Pat. No. 4,445,688 which is incorporated herein in its entirety by reference.

The plastic cladding 7 may be injection molded as a hollow structure shaped to conform to the exterior wall of a half-section of a bowling pin and provide a minimum wall thickness of about 75 to 80 mils. The pin is also provided with a conventional dowel support recess 10 and typically includes a bowling pin base as disclosed in the U.S. Pat. No. 4,322,078 of Rodney C. Mallette, which is also incorporated herein in its entirety by reference.

As disclosed in the aforementioned U.S. Pat. No. 4,445,688, numerous ionomer resins can be employed in forming the cladding. However, the preferred ionomer resin comprises copolymers of ethylene and methacrylic acid, particular the sodium form, having a melt flow of between about 0.5 and 5.0 g/10 min. (ASTM D-1238 Cond. E.) and a flex modulus of between about 40,000 and 60,000 psi (ASTM D-790 A). In the preferred embodiment of the present invention, the cladding 7 comprises DuPont's Surlyn 8920, an ionic copolymer of approximately 96.5 mol % ethylene and 3.5 mol % methacrylic acid having sodium ions uniformly distributed throughout the copolymer in a sufficient amount to effect fifty percent (50%) neutralization of the methacrylic acid. An additional line of ionomers referred to as Iotek is available from Exxon, and Iotek 8000 is preferred.

Figure 2:
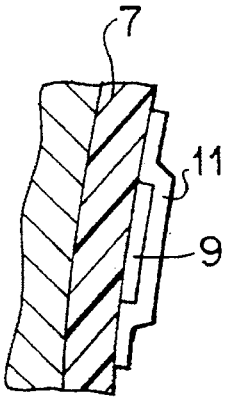
FIG. 2 is a fragmentary detail of the encircled portion of FIG. 1 shown on an enlarged scale.
Figure 3:
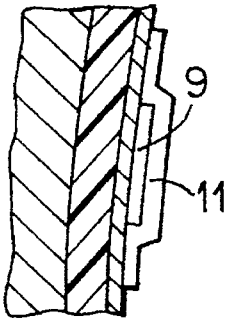
FIG. 3 is a fragmentary detail of the encircled portion of FIG. 1, shown on an enlarged scale, but illustrating a second embodiment of the invention.

A first fluorescent coating 9 is applied to the outer surface of the cladding 7 (shown more clearly in FIG. 2). This first fluorescent coating 9 emits a relatively high level of visible light when subjected to ultraviolet radiation and is confined to a preselected area of the pin 5, as, for example, the neck portion 8 of the pin 5. As illustrated, the first fluorescent coating comprises a pair of bands which pass around the neck 8 of the pin 5. In the preferred embodiment of the invention, the first coating comprises a fluorescent marking with a red, orange or yellow hue which is applied to the area of the pin that is detected by an automatic scoring device. Such colors have been found to be superior for use with a number of automatic scorers. The reason is that some automatic scorers include sensors having red or amber lenses which filter out light in the green/blue end of the spectrum.

Essentially, the entire standing pin surface (excluding the base or flat surface 11 upon which the pin rests) is then coated with a relatively thin transparent polymeric layer 11. The layer 11 also contains a dye which emits visible light under the effect of ultraviolet light, but is essentially colorless under ambient lighting. Automatic bowling scorers sense the position of a pin by light, which is reflected from a pre-selected portion of the pin, as, for example, the neck portion. Therefore, it is important for accurate scoring that under UV or black light conditions, that the emitted light from that portion of the pin is of a sufficient level to activate the sensing device. For this reason, it is important to protect the first fluorescent coating 9 from degradation due to abrasion and other causes. Therefore, a second fluorescent coating or layer 11 is applied over the outer, or exposed, surface of the pin 5 and over the first fluorescent coating 9.

In a preferred embodiment of the invention, the layer 11 includes a fluorescent dye which produces a relatively low level of low-intensity radiation when subjected to ultraviolet light, i.e. the moonglow effect. In addition, the layer 11, which is colorless under ambient conditions but produces a blue glow when subjected to ultraviolet light, allows the higher intensity emission from coating 9 to pass therethrough for detection by the automatic scorer.

In essence, the present invention contemplates a first fluorescent coating which emits a relatively high level of visible light when subjected to ultraviolet light and a second fluorescent coating, the top coat, which emits a relatively low level of visible light when subjected to U.V. radiation. For example, the neck area of a first pin, i.e., one with a "glow" top coat, but without a first fluorescent coating, was subjected to U.V. radiation. When subjected to U.V. radiation, it emitted visible light at an intensity of 53 lux. However, the neck area of a pin with first and second fluorescent coatings, in accordance with a preferred embodiment of the invention, emitted light at a 75 lux level, i.e., approximately fifty percent (50%) greater under the same conditions. The measurement was done in a dark room with a U.V. light about 6 inches from the neck portion of the pin and a light meter 3 inches from the pin. Multiple readings produced essentially the same results, i.e., about a fifty percent (50%) increase, in the lux level.

The outer layer 11 is also more susceptible to degradation of light emittance due to abrasion, soiling, delamination or emittance loss due to prolonged exposure to both ambient and UV light. However, it is presently contemplated that the pins may, in many cases, be refurbished by cleaning, followed by the addition of a new second fluorescent coating 11.

A number of pigments and formulations are presently believed to be suitable for use in the first fluorescent coating 9. For example, the following fluorescent pigments from Day-Glo Color Corp. of Cleveland, Ohio, are presently preferred. The pigments include aurora pink T-11 and GT-11, neon red T-12, rocket red T-13 or GT-13, fire orange T-14 or GT-14N, blaze orange T-15 or GT-15N, arc yellow T-16, saturn yellow T-17N, corona magenta GT-21 and GT-17N. The GT pigments are based on a thermoset resin and are useful in applications where solvent resistance is a concern. This resistance to solvents allows the pins to be cleaned, even if the outer layer 11 is partially removed and facilitates refurbishing of the pins. The GT pigments also have higher color strength than the other pigments.

Other types of pigments, such as those obtained from Automated Entertainment HV Chroic, Inc., of Burbank, Calif., are believed to be suitable. Such pigments are identified as HDTS-34 strong red, HDVT-13 red orange, HDVT-34 strong red, and HDTS-13 red orange.

The vehicle for the fluorescent pigments include a number of polymers. For example, various polymers may be used as vehicles (film formers) for fluorescent coatings. These can be both curable (two-component, thermosetting) and those that form films by the evaporation of solvents or other liquid suspension media. Thermosetting materials are preferred since they bond well to the abraded ionomer surface. Materials that solidify by the evolution of solvents or water usually result in coatings with marginal adhesion to ionomers and often require a primer.

Other classes of applicable vehicles are those that solidify by oxidation and those that solidify when subjected to ultraviolet or electron-beam radiation.

Vehicles which are applicable to this invention are:

Thermosetting (two-component, polymerizable)—epoxies, polyurethanes, ethanes, silicones, phenolics, and materials containing vinyl groups such as unsaturated polyesters;

Non-polymerizable (solidifying by solvent or water evolution) nitrocellulose, cellulose ethers, cellulose acetate, polyvinyl chloride, polyvinyl acetate, polyvinylidene chloride, shellac, acrylics, polyamides, chlorinated rubber, casein, maleated rosins and modified rosin types;

Oxidizing—alkyds and various oleoresinous drying oils such as linseed or tung oil;.

U.V. or electron-beam curing—acrylated polyethers, acrylated urethanes, acrylated epoxies and methacrylated polyesters.

It should be noted that many of the above vehicles (polyurethanes, epoxies, polyvinyl compounds, etc.) are available as latexes or suspensions in a water carrier.

The preferred methods of applying fluorescent coatings to bowling pins are silk screening and pad printing. However, liquid coatings may also be applied by spraying, brushing, dipping, flowing and ink-jet printing. Functional fluorescent markings may also be applied from solids containing fluorescent pigments. These include pressure-sensitive tapes and heat-fusible types such as heat transfer and hot-stamping films. It is also possible that fluorescent films can be placed in the molds that apply the ionomer coating and thereby fuse to the surface of the coating.

The two presently preferred coating formulations are shown in Examples 1 and 2:

EXAMPLE 1

| | |
|---|---|
| Naz-Dar epoxy resin ER-170 | 120 mls. |
| Naz-Dar hardener ER-176 | 1 fluid ounce |
| Day-Glo Rocket Red pigment GT-13 | 70–90 gms. |

EXAMPLE 2

| | |
|---|---|
| Comdec, Inc. clear epoxy resin 380DD | 100 gms. |
| Comdec, Inc. hardener SE-5214 | 30 gms. |
| n-butyl acetate | 17 gms. |
| Day-Glo Rocket Red pigment GT-13 | 52–75 gms. |

EXAMPLE 3

| | |
|---|---|
| Epoxy diacrylate | 50 parts by weight (pbw) |
| Trimethylol propane triacrylate | 5 parts by weight |
| Benzophenone | 10 parts by weight |
| Fluorescent pigment | 35 parts by weight |

EXAMPLE 4

| | |
|---|---|
| Drying alkyd | 35 pbw |
| Linseed oil | 8 pbw |
| Manganese naphthenate | 2 pbw |
| Heptane | 4 pbw |
| Fluorescent pigment | 51 pbw |

EXAMPLE 5

| | |
|---|---|
| Nitrocellulose | 9 pbw |
| Ethyl acetate | 16 pbw |
| Toluene | 27 pbw |
| Ethyl alcohol | 6 pbw |
| Fluorescent pigment | 42 pbw |

EXAMPLE 6

| | |
|---|---|
| Alcohol-soluble acrylic resin | 20 pbw |
| Ethyl alcohol | 32 pbw |
| n-propyl acetate | 17 pbw |
| Microcrystalline wax | 1 pbw |
| Fluorescent pigment | 30 pbw |

EXAMPLE 7

| | |
|---|---|
| Isolated soya protein | 5 pbw |
| Water | 62 pbw |
| Octyl alcohol | 5 pbw |
| Ammonium hydroxide | 2 pbw |
| Microcrystalline wax | 1 pbw |
| Fluorescent pigment | 25 pbw |

EXAMPLE 8

| | |
|---|---|
| Carboxylated acrylic resin | 18 pbw |
| Water | 50 pbw |
| Ammonium hydroxide | 2 pbw |
| Polythylene wax | 1 pbw |
| Fluorescent pigment | 29 pbw |

For ease of production, it is preferred that the coatings be applied to the ionomer coating. However, they may be applied (with ensuing improvement in adhesion) to a primer applied to the ionomer surface. Effective primers are dilute solutions of amine-cured epoxies. The coatings may also be applied between the clear topcoat layers or on the outermost topcoat layer. The latter application is not preferred due to the exposure of the fluorescent markings to abrasion.

While the invention has been described in connection with its preferred embodiments, changes and modification may be made therein without departing from the scope of the appended claims.

What is claimed is:

1. A bowling pin for use with an automatic scorer under visible and/or ultraviolet illumination, said bowling pin comprising a core member, an ionomer cladding having a white outer surface surrounding said core member and a base insert, said bowling pin including a first fluorescent coating on a preselected portion of said outer surface, and said first fluorescent coating emitting a level of visible light when subjected to ultraviolet light for detection by an automatic scorer, and a second fluorescent coating which emits a relatively low level of visible light with respect to that emitted by said first fluorescent coating when subjected to ultraviolet radiation, said second fluorescent coating is essentially colorless under ambient lighting and in which said second fluorescent coating covers essentially the entire standing pin surface including said first fluorescent coating.

2. A bowling pin for use with an automatic scorer under visible and/or ultraviolet illumination according to claim 1, in which said first coating includes a fluorescent pigment.

3. A bowling pin for use with an automatic scorer under visible and/or ultraviolet illumination according to claim 2, in which said second coating includes a fluorescent dye.

4. A bowling pin for use with an automatic scorer under visible and/or ultraviolet illumination according to claim 1, in which said preselected portion of said outer surface is in a neck portion of the pin.

5. A bowling pin for use with an automatic scorer under visible and/or ultraviolet illumination according to claim 4, in which said preselected portion comprises a pair of bands which extend around the neck portion of the pin.

6. A bowling pin for use with an automatic scorer under visible and/or ultraviolet illumination according to claim 5, in which the visible light emitted by the neck portion of the pin, when subjected to ultraviolet radiation, is about fifty percent (50%) greater than the visible light emitted form the neck portion of a pin without said first fluorescent coating.

7. A bowling pin for use with an automatic scorer under visible and/or ultraviolet illumination according to claim 5, in which the visible light emitted by the neck portion of the pin, when subjected to ultraviolet radiation, is at least about 75 lux.

* * * * *